United States Patent [19]

Bieri

[11] Patent Number: 4,572,580

[45] Date of Patent: Feb. 25, 1986

[54] MOBILE CONCRETE OR ROCK CUTTING APPARATUS

[75] Inventor: Hans Bieri, Pfaeffikon, Switzerland

[73] Assignee: Hydrostress AG, Pfaeffikon, Switzerland

[21] Appl. No.: 569,178

[22] Filed: Jan. 9, 1984

[30] Foreign Application Priority Data

Jan. 21, 1983 [CH] Switzerland ..... 350/83

[51] Int. Cl.[4] ..... E21C 25/20

[52] U.S. Cl. ..... 299/1; 299/39

[58] Field of Search ..... 299/1, 39

[56] References Cited

U.S. PATENT DOCUMENTS

| | | | |
|---|---|---|---|
| 2,736,544 | 2/1956 | Wright | 299/39 |
| 2,934,327 | 4/1960 | Lewis | 299/39 |
| 3,779,607 | 12/1973 | Staab | 299/39 |
| 4,041,623 | 8/1977 | Miller et al. | 37/108 R |
| 4,175,788 | 11/1979 | Jacobson et al. | 299/39 |
| 4,200,335 | 4/1980 | Moynihan et al. | 299/10 |

*Primary Examiner*—James A. Leppink
*Assistant Examiner*—M. A. Goodwin
*Attorney, Agent, or Firm*—W. G. Fasse; D. H. Kane, Jr.

[57] ABSTRACT

An instantaneous desired cutting position of a milling cutter or circular saw blade in a mobile apparatus for cutting hard materials, such as a concrete highway surface, is maintained even if the mobile apparatus travels over irregular or slanted surfaces. For this purpose the saw blade position is adjustable either by varying the position of the saw blade mounting in a machine frame or by varying the position of the entire machine frame. The position correction is accomplished by a sensor which produces control signals for a position correction power drive in response to pendulum movements which represent cutter or blade deviations from the desired cutting position. The position of the entire machine frame may be varied by raising or lowering a wheel remote from the cutter or blade. Thus, a binding or jamming of the cutter or blade is prevented.

19 Claims, 5 Drawing Figures

MOBILE CONCRETE OR ROCK CUTTING APPARATUS

BACKGROUND OF THE INVENTION

The invention relates to a mobile concrete or rock cutting apparatus, more specifically, to a machine capable of cutting into concrete surfaces such as road surfaces or the like by using a circular milling cutter or circular saw blade. The apparatus is supported on wheels.

Mobile machines of this type comprising a circular saw blade or milling cutter for a material removing milling or machining operation of different materials are known. Frequently, such machines are equipped with a circular saw blade having a relatively small diameter because large cutting depths are not needed where relatively shallow grooves are required to be cut into road surfacing layers or the like. However, where large cutting depths are required, especially when thick concrete floors or concrete slabs are to be severed, it is necessary to use large diameter saw blades having a diameter up to about 1500 mm. The problem with such large diameter saw blades is seen in that they easily bind or jam when the mobil apparatus during the cutting operation must travel over uneven surfaces or even on merely slanted surfaces because under such operating conditions even a very small tilting of the circular saw blade out of its main plane will result in the mentioned jamming or binding and due to the large penetration of the saw blade into the material being cut. Such binding or jamming in turn causes a substantial heating of the blade and a respective reduction in the cutting capacity. Under certain circumstances the blade may even be completely destroyed.

Incidentally, the "main plane" of the sawing blade in this context is the plane defined by the body of the saw blade and extending perpendicularly to the rotational axis of the saw blade.

OBJECTS OF THE INVENTION

In view of the above it is the aim of the invention to achieve the following objects singly or in combination:

- to construct a mobile apparatus of the type described which is capable of providing large cutting depths without the jamming or binding of the saw blade even if the saw blade has a substantial, large diameter;
- to provide a device which will continuously maintain a predetermined saw blade cutting position relative to this mentioned main plane of the saw blade even if the surface on which the machine is travelling is uneven or slanted;
- to correct the saw blade position in response to any deviation of the saw blade from a reference plane, whereby such reference plane may extend vertically or at a certain angle relative to the vertical; and
- to provide an apparatus which is especially suitable for cutting grooves into road surface layers, even if such road surfaces are slanted.

SUMMARY OF THE INVENTION

According to the invention there is provided a mobile apparatus provided with a circular milling cutter or circular saw blade which is equipped with a control and correction mechanism which senses any deviation of the cutter or saw blade from a predetermined reference position under all operating conditions and which provides a control signal representing such a deviation for operating correction means which maintain the saw blade in the desired reference position. The correction may be accomplished by changing the angular position of a saw blade mounting relative to a machine frame or by changing the position of the machine frame to thereby also change the position of the saw blade mounting, for example, by elevating or lowering a wheel on which the machine frame is supported and which wheel is located remote from the saw blade location.

This type of structure prevents the mentioned jamming or binding of the saw blade in its cut slot. Moreover, the cutting capacity is improved because the friction between the side surfaces of the cutting blade and the inwardly facing surfaces of the cut groove in the material being cut is optimally reduced.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
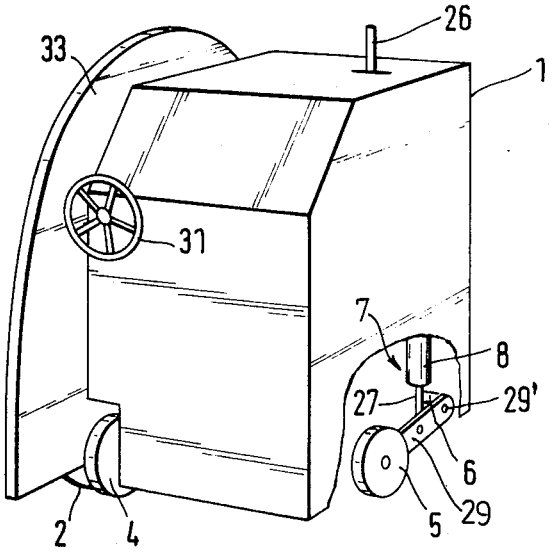
FIG. 1 is a perspective overall view of a cutting or milling apparatus according to the invention.
Figure 2:
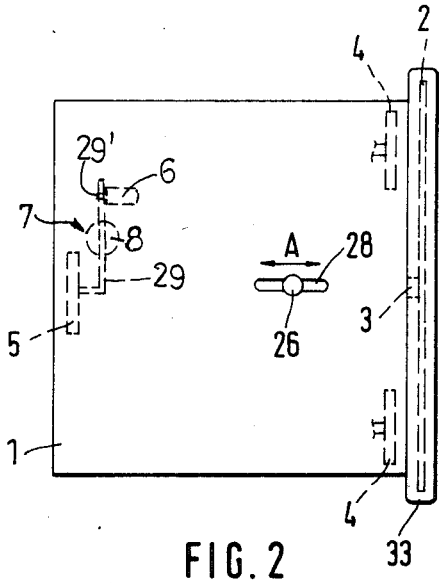
FIG. 2 is a top plan view onto the present machine in a schematic illustration.

FIG. 1 shows the mobile concrete or rock milling or cutting apparatus in a perspective view. A machine frame 1 supports a circular saw blade 2 by saw blade mounting means not shown in detail in FIG. 1. The blade 2 is protected by a blade guard housing 33 which merely permits the lower portion of the blade 2 to project outside of the guard housing 33. The blade 2 has a relatively large diameter of up to about 1500 mm. The vertical adjustment of the saw blade 2 and thus of the cutting depth is accomplished by conventional means operable through a hand wheel 31. The saw blade 2 is connected in a torque transmitting manner to a drive shaft 3 which is rotatable in the mentioned blade mounting bearing means and the shaft 3 is driven by a motor not shown.

The machine frame 1 is supported by three wheels operatively secured to the bottom of the machine frame. Two wheels 4 are arranged along the frame edge near the saw blade 2. The third wheel 5 is operatively supported near the opposite lower edge of the machine frame 1 remote from the saw blade 2. The wheels 4 are individually rotatable about a vertical axis so as to make the radius of turning the entire machine frame as small as possible. The wheel 5 is supported on a bearing arm 6 movable by a tilting lever 29 pivoted or journalled at 20' and operable by a piston cylinder arrangement 7 having a cylinder 8 and a piston rod 27 connected to the tilting lever 29. The lifting or lowering of the wheel 5 will be described in more detail below. As a modification a forth weel could be arranged remote from the saw blade 2, also operable parallel by a piston cylinder arrangement 7.

Since the wheels 4 and 5 do not travel on rails, they are bound to follow irregularities in the surface on which the apparatus is moving, whereby the machine frame 1 may tilt relative to a true vertical line. As a result, the saw blade 2 could also deviate from a predetermined reference plane when such irregularities in the surface are encountered. The invention provides means for maintaining the saw blade 2 in a predetermined cutting position relative to a reference plane whereby the proper cutting position of the blade would coincide with the reference plane. This correction or maintenance of the desired blade position is accomplished by sensing and control means which continuously sense the position of the machine frame 1 relative to the reference plane and thus relative to the instantaneous position of the saw blade, whereby correction signals are produced which represent a deviation of the actual saw blade position from the reference plane and these control signals are used to operate power driven correction means as will now be described.

Figure 3:
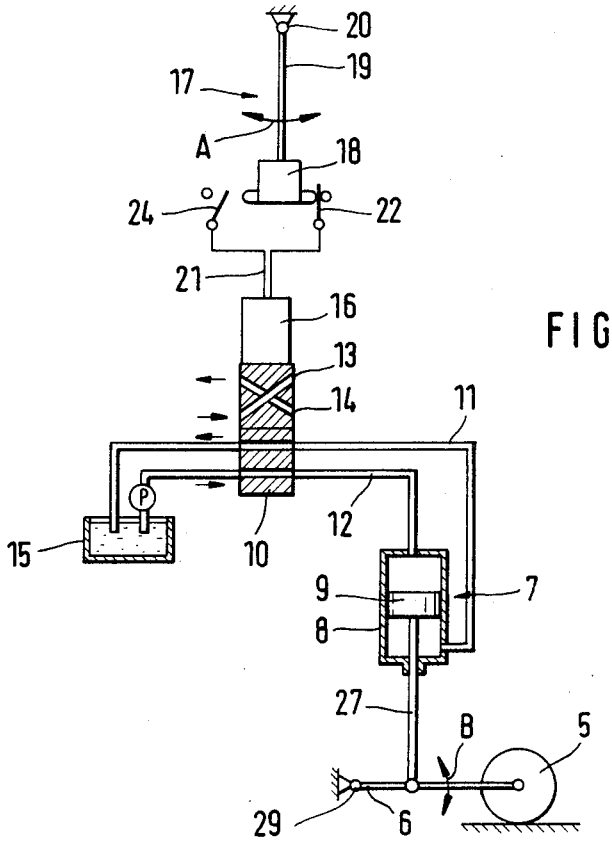
FIG. 3 shows a circuit diagram of the control and correction components of the present apparatus.

The control and sensing means comprise a pendulum device 17 including a pendulum 19 supported by a first journal shaft 20 defining a first journal axis extending horizontally and in parallel to the above defined main plane of the circular saw blade so that deviations of the main saw blade plane from a reference plane may be sensed by the pendulum 19 making excursions toward and away from the saw blade 2. These excursions of the pendulum 19 are shown by the double arrow A in FIG. 5. As the pendulum 19 travels out of its vertical position, it produces a correction signal which corresponds to or represents a deviation of the main saw blade plane from a reference plane. This is shown schematically in FIG. 3. In the illustrated position the switch 22 is closed while the switch 24 located opposite the switch 22, is open. The switches 22 and 24 are shown for simplicity's sake as electrical contacts in FIG. 3. In reality, these switches may be constructed as sensors or proximity switches 36 operating on a capacity changing basis or on a magnetic basis.

Both switches 22 and 24 are connected through electrical conductors 21 to an electrical control device 16 for controlling a multipath valve 10. This valve 10 controls the supply of hydraulic pressure fluid to the piston cylinder device 7 through the supply and discharge conduits 11 and 12. The control device 16 forming part of the multipath valve 10 can connect the outputs to the conduits 13 and 14 rather than to the conduits 11 and 12 to thereby reverse the pressure on the piston 9. Since the piston cylinder device 7 is constructed to be effective in both ways, it is possible to apply a pressure to the piston 9 in the cylinder 8 selectively on one or the other piston surface so that the piston 9 moves in one or the other direction. This movement of the piston 9 is transmitted through the piston rod 27 to the pivot arm 29 and thus to the arm 6 of the wheel 5 so that the wheel may be pivoted in the directions of the double arrow B. Thus, if the switch 22 is closed by the weight 18 secured to the lower end of the pendulum 19, hydraulic fluid under pressure from the pressure container 15 is supplied to one side of the piston 9.

On the other hand, when the switch 24 is closed by the weight 18 of the pendulum 19, then the control valve 16 is reversed and the multipath valve 10 causes a supply of hydraulic fluid under pressure to the opposite side of the piston 9 with the result that the tilting lever 29 of the wheel 5 is now moved in the opposite direction. Since the tilting lever 29 of the bearing arm 6 is pivoted at 29', the resulting movment causes a lifting or lowering or rather pivoting of the machine frame to an extent sufficient to keep or maintain the saw blade 2 in the desired reference position.

Figure 4:
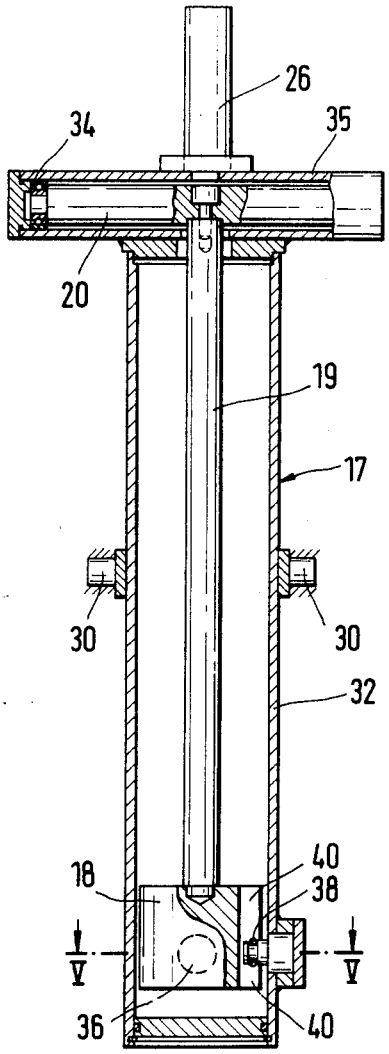
FIG. 4 shows a vertical section through a pendulum arrangement for sensing any deviations of the cutter or saw blade from a reference plane.
Figure 5:
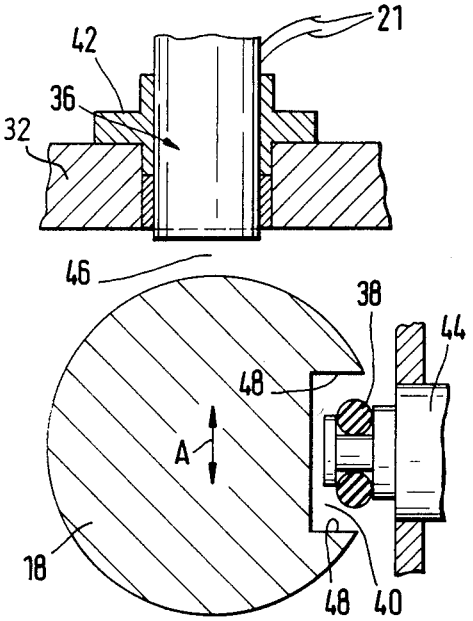
FIG. 5 is a sectional view along section line V—V in FIG. 4.

As shown in FIGS. 4 and 5, the pendulum device 17 comprises a pendulum weight 18 secured to the lower end of the pendulum 19 proper which is mounted in a protective housing such as a tubular housing 32, whereby the first journal axis or shaft 20 to which the pendulum 19 is rigidly secured, is tiltably mounted in a bearing housing, for example, a pipe member 35 by means of antifriction bearings 34. The bearing pipe or housing 35 is rigidly secured to the protective housing 32. The protective housing 32 in turn is journalled to a second journal axis defined by the journal bearings 30 rigidly held in the machine frame 1. The second journal axis of the housing of the pendulum defined by the journal bearings 30 extends in parallel to the first pendulum journal axis 20.

An adjustment lever or handle 26 is rigidly secured to the journal bearing housing or pipe 35. The lever or handle 26 extends through a slot 28 in the top of the machine frame so that it may be manipulated by an operator for adjusting the pendulum housing 32 into a predetermined position, whereby the vertical rest position of the pendulum 19 may represent the zero or reference position.

Stop means such as a damping ring 38 are provided for limiting the pendulum excursions. The ring 38 reaches into a groove 40 of the pendulum weight 18. The damping ring 38 is held in a support member 44 mounted to the protective housing 32 of the pendulum device. The width of the groove 40 between the groove defining walls 48 as shown in FIG. 5 is larger than the outer diameter of the damping ring 38 to permit a certain movement of the pendulum weight 18 in the direction of the double arrow A, whereby the air gap 46 between the weight 18 and a sensing member 36 is changed and sensed by the sensing member 36 to produce a control signal as a function of the width of the air gap 46. The sensing member 36 is adjustably connected through a bearing sleeve 42 to the protective tubular housing 32. By pushing the sensing member 36 more or less through the sleeve 42, the position of the sensing member 36 relative to the pendulum weight 18 is adjustable in the direction of pendulum excursions A. The damping ring 38 is of elastic material.

The operation of the pendulum device 17 is as follows. Let it be assumed that in a thick concrete wall a deep slot is to be cut and that the depth of the slot is to extend vertically. Therefore, the circular saw blade 2 must be maintained in a reference or main plane which also extends vertically. Accordingly, the pendulum device 17 is also brought into the zero position by operating the handle 26 to register with a zero position which may be marked on a scale on top of the machine frame. As a result of switching on the pump motor for feeding hydraulic fluid under pressure and as a result of switching on the electrical system of the machine, one of the two switches 22 and 24 is closed by the pendulum weight. Therefore, hydraulic fluid under pressure is applied to one side of the piston 9 with the result that the wheel 5 located remote from the saw blade 2 is adjusted in the direction of the arrow B. Due to this wheel adjustment the entire machine frame 1 is slightly tilted. However, the pendulum 18, 19 retains its vertical position, whereby the other switch is closed and the first closed switch is opened. As a result, the control device switches over the multipath valve 10 to thereby supply hydraulic fluid under pressure to the other piston surface. This in turn causes movement of the pivoting arm 29 and thus of the arm 6 in the opposite direction to bring the wheel 5 back into the original position or elevation. As a result of these continuing correctional movements, the circular saw blade 2 will also perform slight pendulum type movememts about its vertical position forming the reference plane. This type of movement of the saw blade is desired because it results in a slot width slightly larger than the thickness of the saw blade, whereby friction between the side surfaces of the saw blade and the side walls of the groove being cut is minimized or substantially reduced. When now, an irregularity occurs in the surface on which the machine travels, and when the front wheel 4 first encounters this irregularity in the travel direction, the entire machine frame is tilted as a result, whereby the pendulum device 17 does not follow this tilting movement of the entire machine frame. Rather, the pendulum device 17 retains its vertical position with the result that it causes a control operation because the air gap 46 is changed, whereby the wheel 5 is lifted or lowered, depending on the irregularity encountered, to perform the required correctional movement. This feature of the invention has the advantage that the apparatus can travel over irregularities without the need for installing rails or without any requirement of first removing these irregularities in the surface on which the machine travels.

In certain applications it is desirable that the circular saw blade 2 makes a cut which is slightly inclined relative to the vertical, for example, by 5°. Such a cutting requirement is, for example, to be satisfied when a plate is to be cut out of a surface because the lifting of the plate out of the surface is facilitated by such a slightly inclined cutting groove. The cut plate may be rectangular or square or the like. These slightly inclined cutting grooves then provide a cross-sectional shape for the cut plate which is not rectangular, but has a slightly trapezoidal form which greatly facilitates the upward lifting of the cut plate. For this purpose the pendulum device 17 is manually adjusted by means of the lever 26 into an inclined position, whereupon the present apparatus automatically adjusts itself to this new reference position during the cutting operation. Another advantage of this adjustment possibility is seen in that even along inclined surfaces it is possible to cut a groove which extends vertically.

Referring first to FIG. 5 which shows a sensor 36 in the form of a proximity switch, it is possible to replace such a proximity switch by other sensors, for example, in the form of sensing members forming part of a microswitch, whereby these sensing members reach into cooperation with the groove defining surfaces 48 in the pendulum weight 18. The excursions of the pendulum then would alternately operate one or the other of such microswitches. The control could also be accomplished by means of light beams which sense the instantaneous excursion direction of the pendulum weight 18. The sensing light beam could either sense directly the position of the pendulum weight 18 or it could sense through an apertured plate connected to the pendulum weight 18.

A further modification provides that the multipath valve 10 is equipped with a zero position in which the piston 9 is not provided with any hydraulic fluid under pressure on either of its sides. Only after larger deviations from the reference planes are sensed, such valve would open the respective supply conduits.

Although the invention has been described with reference to specific example embodiments, it will be appreciated, that it is intended to cover all modifications and equivalents within the scope of the appended claims.

What is claimed is:

1. A mobile apparatus for cutting hard materials, such as concrete, comprising a machine frame, wheel means for supporting said machine frame, a circular saw blade, saw blade mounting means for rotatably mounting said circular saw blade in said machine frame to take up a predetermined cutting position, saw blade position sensor means operatively arranged for sensing the instantaneous position of said saw blade, and saw blade position correction means in said machine frame responsive to said position sensor means for automatically maintaining said saw blade in said predetermined cutting position even if said machine frame travels on a slanted or uneven surface, wherein said saw blade position sensor means comprise pendulum means and at least one sensing member operatively arranged for sensing the instantaneous position of said pendulum means, wherein said saw blade position correction means comprise power drive means operable in response to said sensing member for maintaining said saw blade in said predetermined position, and wherein the position of said sensing member relative to said pendulum means is adjustable in the direction of pendulum excursions.

2. The apparatus of claim 1, wherein said saw blade position correction means are operatively connected to at least one of said wheel means remote from said saw blade for adjusting the entire machine frame to a position in which the predetermined cutting position of said saw blade is maintained.

3. The apparatus of claim 1, wherein said saw blade position correction means are operatively connected to said machine frame for adjusting said saw blade mounting means relative to said machine frame to a position in which the predetermined cutting position of said saw blade is maintained.

4. The apparatus of claim 1, wherein said power drive means are operatively connected to one of said wheel means remote from said saw blade for adjusting the entire machine frame to a position in which the predetermined cutting position of said saw blade is maintained.

5. The apparatus of claim 1, wherein said power drive means are operatively connected to said machine frame for adjusting said saw blade mounting means relative to said machine frame to a position in which the predetermined cutting position of said saw blade is maintained.

6. The apparatus of claim 1, wherein said power drive means comprise a hydraulic multipath valve operatively arranged for control by said sensing member, and hydraulic piston cylinder means operatively connected for control by said multipath valve, said hydraulic piston cylinder means being operatively arranged at least between one of said wheel means and said machine frame for adjustingthe saw blade position.

7. The apparatus of claim 1, wherein said saw blade defines a blade main plane extending in the saw blade perpendicularly to a rotational axis of said saw blade, and wherein said pendulum means comprise a pendulum housing operatively supported in said machine frame, a pendulum journal axis and a pendulum operatively secured to said pendulum journal axis in said pendulum housing, said pendulum journal axis extending in said pendulum housing in parallel to said blade main plane and so that said pendulum can swing toward and away from said saw blade, said pendulum housing also having a housing journal axis mounted in said machine frame and extending in parallel to said pendulum journal axis, position adjustment means extending out of said machine frame and rigidly secured to said pendulum housing for adjusting said pendulum housing into a desired position by tilting said pendulum housing about said housing journal axis, said sensing member being operatively arranged for sensing excursions of said pendulum.

8. The apparatus of claim 7, further comprising stop means arranged for limiting pendulum excursions.

9. The apparatus of claim 7, wherein said pendulum housing is a tubular member and wherein said adjustment means comprise a handle rigidly secured to said tubular member for tilting the tubular member about said housing journal axis into said desired position.

10. The apparatus of claim 7, further comprising stop means for limiting pendulum excursions, said pendulum having a weight with a lateral groove therein, said stop means reaching into said lateral groove, said sensing member being arranged for sensing changes in the width of an air gap between said pendulum weight and said sensing member for producing a control signal for operating said saw blade position correction means.

11. The apparatus of claim 10, wherein said stop means are secured to and extend through said pendulum housing.

12. The apparatus of claim 10, wherein said stop means comprise a damping ring of elastic material operatively held in said lateral groove which is wider than the outer diameter of said damping ring.

13. A mobile apparatus for cutting hard materials, such as concrete, comprising a machine frame, wheel means for supporting said machine frame, a circular saw blade, saw blade mounting means for rotatably mounting said circular saw blade in said machine frame to take up a predetermined cutting position, saw blade position sensor means operatively arranged for sensing the instantaneous position of said saw blade, and saw blade position correction means in said machine frame responsive to said position sensor means for automatically maintaining said saw blade in said predetermined cutting position even if said machine frame travels on a slanted or uneven surface, wherein said saw blade position sensor means comprise pendulum means and at least one sensing member operatively arranged for sensing the instantaneous position of said pendulum means, wherein said saw blade position correction means comprise power drive means operable in response to said sensing member for maintaining said saw blade in said predetermined position, wherein said power drive means are operatively connected to one of said wheel means remote from said saw blade for adjusting the entire machine frame to a position in which the predetermined cutting position of said saw blade is maintained, wherein said power drive means comprise a hydraulic multipath valve operatively arranged for control by said sensing member, and hydraulic piston cylinder means operatively connected for control by said multipath valve, said hydraulic piston cylinder means being operatively arranged at least between one of said wheel means and said machine frame for adjusting the saw blade position, wherein said saw blade defines a blade main plane extending in the saw blade perpendicularly to a rotational axis of said saw blade, and wherein said pendulum means comprise a pendulum and a pendulum journal axis for supporting said pendulum in said machine frame, said pendulum journal axis extending in said machine frame in parallel to said blade main plane and so that said pendulum can swing toward and away from said saw blade.

14. The apparatus of claim 13, further comprising stop means arranged for limiting pendulum excursions.

15. The apparatus of claim 13, further comprising a pendulum housing in said machine frame, said pendulum journal axis being mounted in said machine frame, said pendulum housing having a housing journal axis (30) mounted in said machine frame and extending in parallel to said pendulum journal axis, position adjustment means extending out of said machine frame and rigidly secured to said pendulum housing for adjusting said pendulum housing into a desired position by tilting said pendulum housing about said housing journal axis, said sensing member being operatively arranged for sensing excursions of said pendulum.

16. The apparatus of claim 15, wherein said pendulum housing is a tubular member and wherein said position adjustment means comprise a handle rigidly secured to said tubular member for tilting the tubular member about said housing journal axis (30) into said desired position.

17. The apparatus of claim 13, further comprising stop means for limiting pendulum excursions, said pendulum having a weight with a lateral groove therein, said stop means reaching into said lateral groove, said sensing member being arranged for sensing changes in the width of an air gap between said pendulum weight and said sensing member for producing a control signal for operating said saw blade position correction means.

18. The apparatus of claim 13, further comprising electrical control means (16) for operating said multipath valve, and wherein said sensing member actuates said electrical control means (16) of said multipath valve in response to said pendulum means.

19. The apparatus of claim 18, wherein said sensing member comprises two electrical switches (22, 24) operatively arranged for operation by said pendulum means and connected to said electrical control means (16) for operating said multipath valve.

* * * * *